US009032584B1

(12) United States Patent
McAvoy

(10) Patent No.: US 9,032,584 B1
(45) Date of Patent: May 19, 2015

(54) HANDHELD CLEANING TOOL KIT

(71) Applicant: Casey McAvoy, Hays, KS (US)

(72) Inventor: Casey McAvoy, Hays, KS (US)

( * ) Notice: Subject to any disclaimer, the term of this patent is extended or adjusted under 35 U.S.C. 154(b) by 297 days.

(21) Appl. No.: 13/648,959

(22) Filed: Oct. 10, 2012

(51) Int. Cl.
*A47L 13/10* (2006.01)
*A47L 13/256* (2006.01)
*B65D 83/08* (2006.01)

(52) U.S. Cl.
CPC ..... *A47L 13/256* (2013.01); *B65D 83/08* (2013.01)

(58) Field of Classification Search
CPC ..... A47L 13/256; A47L 13/20; A47L 13/24; A47L 13/44; B65D 83/08
USPC ..... 15/231, 228, 98, 143.1
See application file for complete search history.

(56) References Cited

U.S. PATENT DOCUMENTS 1,913,105 A * 6/1933 Case et al. ..... 206/362
5,596,787 A 1/1997 Stevens et al.
6,550,639 B2 * 4/2003 Brown et al. ..... 221/135
7,350,257 B2 4/2008 McKay
7,681,276 B2 3/2010 Rothweil et al.
7,745,354 B2 6/2010 Tsuchiya et al.
2006/0277706 A1 * 12/2006 Clark et al. ..... 15/231

* cited by examiner

*Primary Examiner* — Shay Karls
(74) *Attorney, Agent, or Firm* — Crossley Patent Law

(57) ABSTRACT

A handheld cleaning tool kit including a handheld base with interchangeable cleaning sheets formed of cleaning substances attached thereto and a grip body, having a non-slip exterior surface, is disposed on a bottom surface thereof. Securement structures are disposed within the top surface proximal to each corner thereof. Each securement structure includes a flexible mount portion and a cross-shaped slit, which deflects under finger pressure into a recess directly below the slit, centrally disposed within the mount portion to secure a portion of the cleaning sheet to the body upon pushing the portion of the cleaning sheet through the slit and into the recess. A handle is centrally disposed on the top surface. A magnetic frame includes a pair of clip members disposed in a first portion to removably retain the base against a front surface thereof and a cleaning sheet dispenser disposed within a second portion thereof.

6 Claims, 3 Drawing Sheets

HANDHELD CLEANING TOOL KIT

BACKGROUND OF THE INVENTION

Various types of cleaning tools with removable cleaning sheets are known in the prior art. However, what is needed is a handheld cleaning tool kit with a handheld base for the attachment thereto of interchangeable cleaning sheets formed of a selected cleaning substance and a grip body, having a non-slip exterior surface, is disposed on a bottom surface thereof. Securement structures are disposed within the top surface proximal to each corner thereof. Each securement structure includes a flexible mount portion and a cross-shaped slit, which deflects under finger pressure, centrally disposed within the mount portion to secure a portion of the cleaning sheet to the body upon pushing the portion of the cleaning sheet into the slit. A handle is centrally disposed on the top surface. A magnetic frame includes a pair of clip members disposed in a first portion to removably retain the base against a front surface thereof. A cleaning sheet dispenser is disposed within a second portion of the frame front surface.

FIELD OF THE INVENTION

The present invention relates to handheld cleaning tools, and more particularly, to a handheld cleaning tool kit with disposable cleaning sheets attached to a base with securement structures having a flexible mount portion with a cross-shaped slit that is deflected under finger pressure into a recess below the slit to secure a cleaning sheet against the base as well as a magnetic frame to retain the base and a cleaning sheet dispenser.

SUMMARY OF THE INVENTION

The general purpose of the present handheld cleaning tool kit, described subsequently in greater detail, is to provide a handheld cleaning tool kit which has many novel features that result in a handheld cleaning tool kit which is not anticipated, rendered obvious, suggested, or even implied by prior art, either alone or in combination thereof.

To accomplish this, the present handheld cleaning tool kit includes a handheld base designed for the attachment of an interchangeable cleaning sheet thereto. A grip body is disposed on a bottom surface thereof with a non-slip exterior surface. Spaced apart securement structures are disposed within the top surface proximal to each corner thereof. Each securement structure includes a flexible mount portion and a cross-shaped slit centrally disposed within the mount portion. The slit of each securement structure deflects under finger pressure into a recess directly below the slit and is configured to secure a portion of one of the disposable cleaning sheets to the body upon pushing the portion of the cleaning sheet through the slit and into the recess. A handle is centrally disposed on the top surface.

A magnetic frame provided as part of the kit includes a pair of clip members disposed in a first portion in a position parallel to each other to removably retains the handheld base against the front surface of the frame. A cleaning sheet dispenser is disposed within a second portion of the magnetic frame front surface. Each cleaning sheet is formed of a cleaning substance, which can be one of a glass cleaner, a furniture dust remover, and a furniture wax.

The instant kit makes the cleaning of small household surfaces, such as a kitchen countertop or glass tabletop and small household messes easier and more quickly than cleaning devices such as paper towels. The magnetic frame permits the magnetic mounting of the frame to a mount surface such as a refrigerator exterior thus allowing convenient access to the handheld mop and cleaning sheet dispenser disposed within the frame. Adhesive strips can also be provided to attach the magnetic frame to nonmagnetic surfaces.

The handheld base has each of a length and a width that is in a range of approximately 3 inches to 6 inches and a depth in a range of ¼inch to ½ inch. Each cleaning sheet has a length and a width approximately 2 inches longer and wider than the handheld base. In addition, each cleaning sheet is formed of one of a wide variety of cleaning substances, such as a glass cleaner, a furniture dust remover, or a furniture wax, to clean a wide variety of household surfaces. The handheld base is also configured to secure a replaceable sponge or a scouring pad thereto.

Thus has been broadly outlined the more important features of the present handheld cleaning tool kit so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
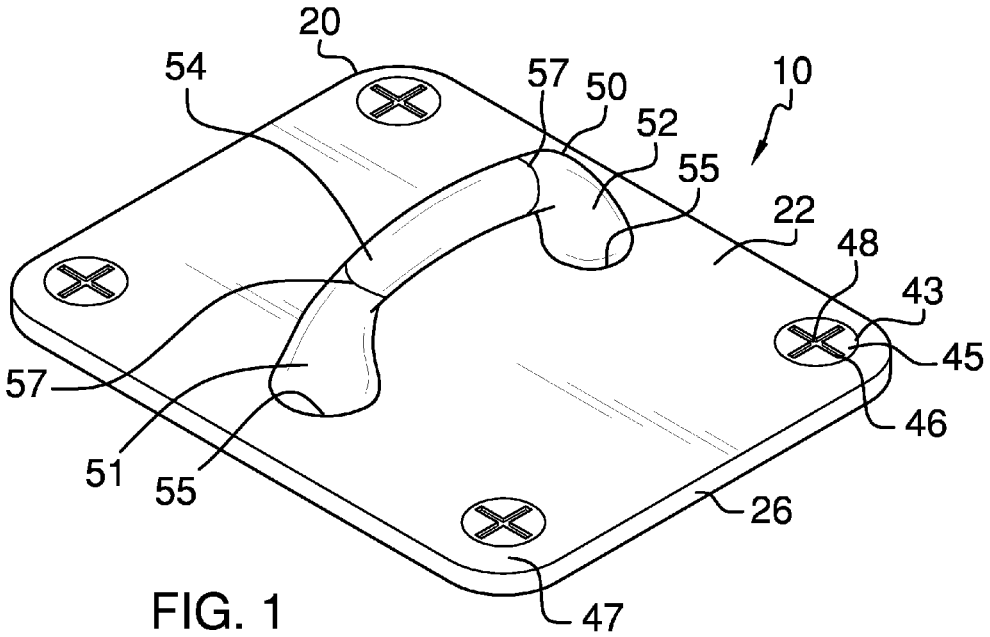
FIG. 1 is an isometric view of a handheld base.
Figure 2:
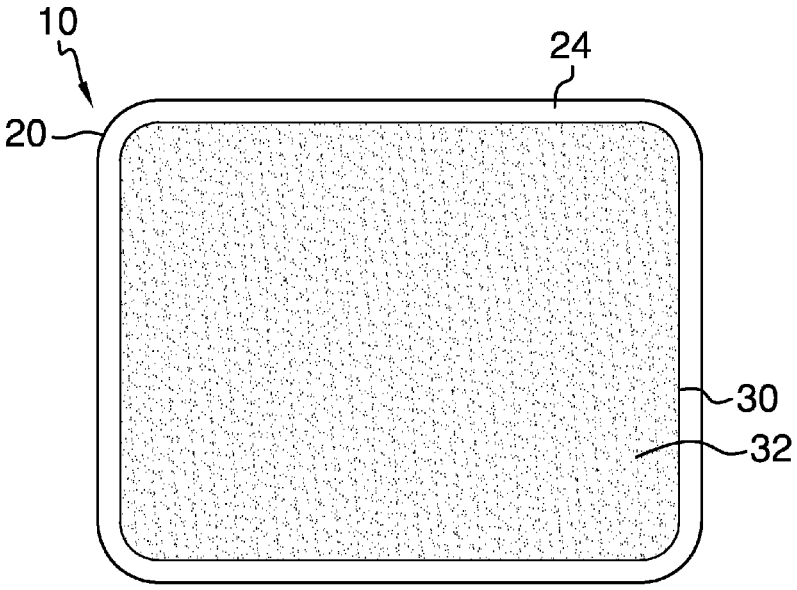
FIG. 2 is a bottom plan view of the handheld base.
Figure 3:
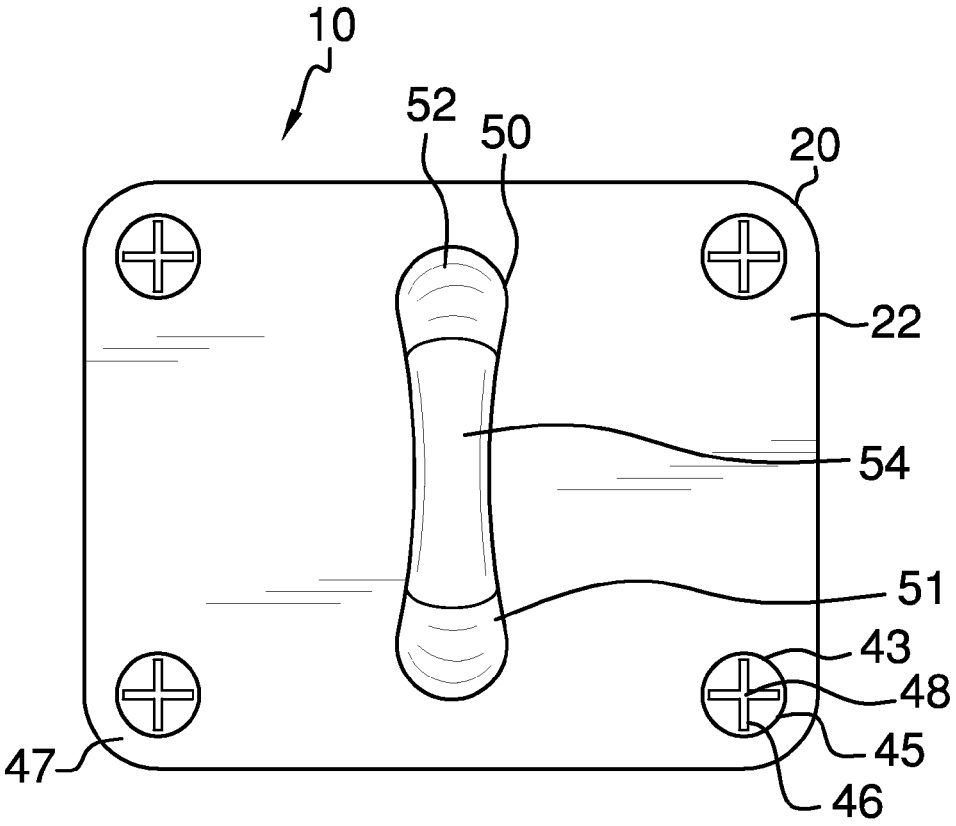
FIG. 3 is a top plan view of the handheld base.
Figure 4:
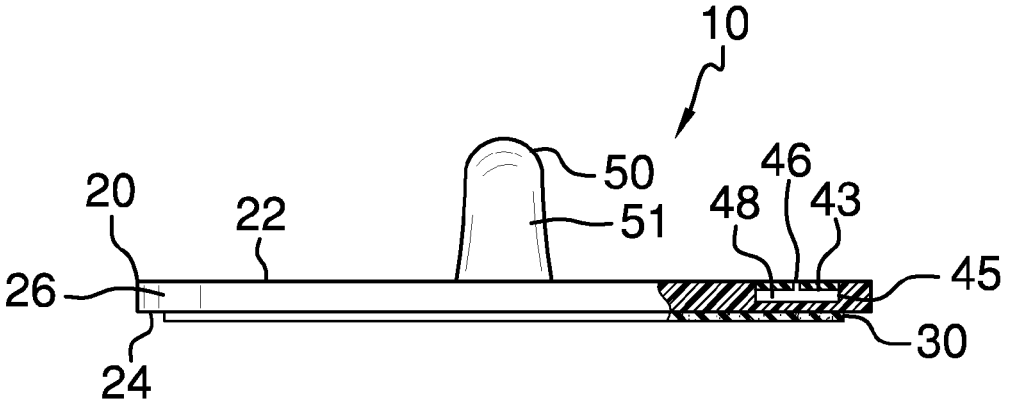
FIG. 4 is a front elevation view with a partial cutaway showing a securement structure.
Figure 5A:
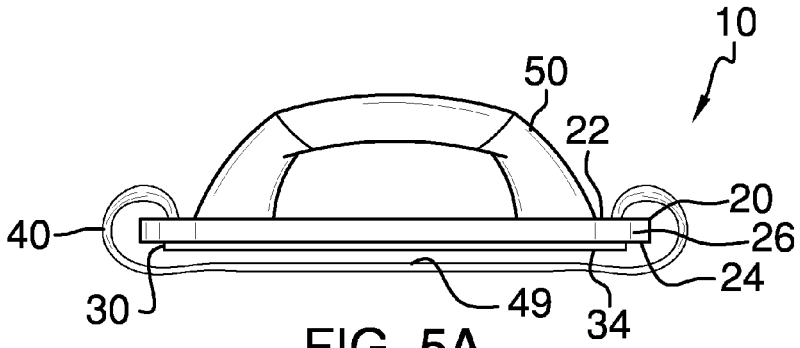
FIG. 5*a* is an in-use right side elevation view showing a cleaning sheet mounted to a handheld base.
Figure 5B:
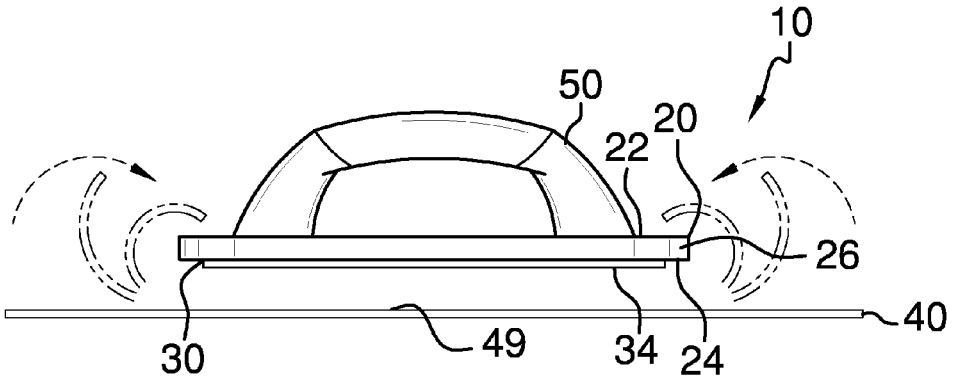
FIG. 5*b* is an in-use right side elevation view showing the bending of the cleaning sheet to be mounted to the handheld base.
Figure 6:
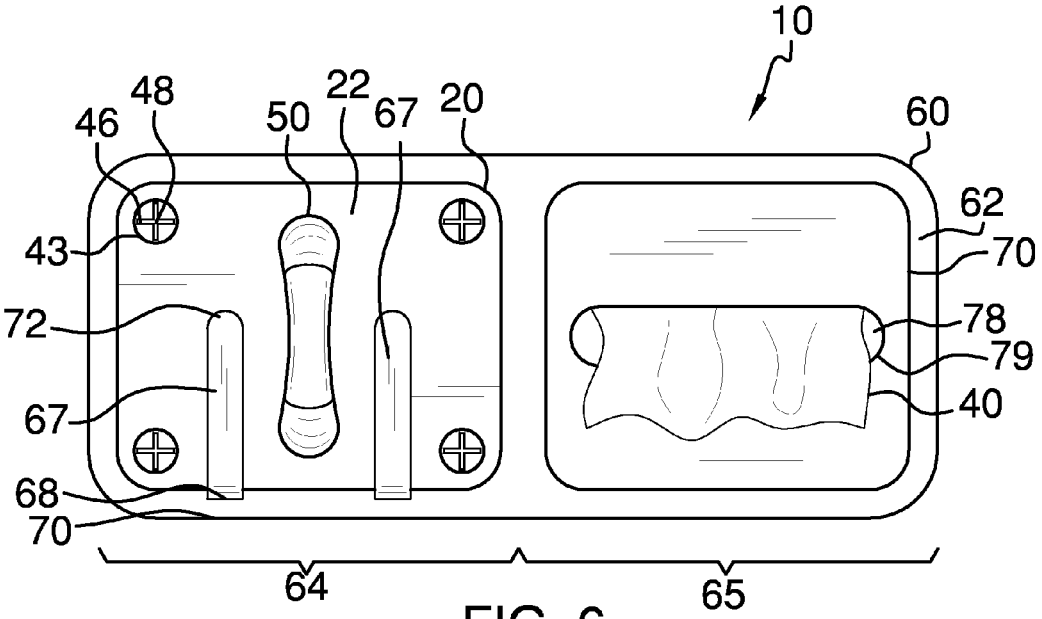
FIG. 6 is a top plan view of a magnetic frame with the handheld base and a cleaning sheet dispenser disposed therein.

With reference now to the drawings, and in particular FIGS. 1 through 6 thereof, example of the instant handheld cleaning tool kit employing the principles and concepts of the present handheld cleaning tool kit and generally designated by the reference number 10 will be described.

Referring to FIGS. 1 through 6 a preferred embodiment of the present handheld cleaning tool kit 10 is illustrated. The present handheld cleaning tool kit 10 includes a handheld base 20 having a top surface 22, a bottom surface 24, and a continuous perimeter 26 therebetween. A grip body 30 is disposed on the bottom surface 24. The grip body 30 covers substantially the entire bottom surface 24. A non-slip exterior surface 32 is disposed on substantially an entire outer surface 34 of the grip body 30. The handheld cleaning tool kit 10 also includes a plurality of disposable and interchangeable cleaning sheets 40 that are individually removably attached to the handheld base 20.

A plurality of spaced apart securement structures 43 is disposed within the top surface 22. Each securement structure 43 includes a flexible mount portion 45 and a cross-shaped slit 46 centrally disposed within the mount portion 45. Each securement structure 43 is disposed at one of a corner 47 of the top surface 22. The slit 46 of each securement structure 43 is configured to deflect under finger pressure into a recess 48 disposed directly below the securement structure 43. The slit 46 of each securement structure 43 is configured to secure a portion of one of the disposable cleaning sheets 40 to the base 20 upon pushing the portion of the cleaning sheet 40 through the slit 46 and into the recess 48. In addition, the non-slip exterior surface 32 is configured to secure an interior side 49 of the cleaning sheet 40 to the bottom surface 24 of the grip body 30.

A handle 50 is centrally disposed on the top surface 22. The handle 50 has a first attachment end 51, a second attachment end 52, and a center grip portion 54 disposed therebetween. Each of the first and second attachment ends 51, 52 has a distal end 55 attached to the top surface 22 of the base 20 and a proximal end 57. The distal end 55 has a diameter larger than a diameter of the proximal end 57 to provide a sturdier attachment of the handle 50 to the top surface 22 than would be provided if the diameter of the distal end 55 were either equal to or smaller than the diameter of the proximal end 57.

A magnetic frame 60 is also provided in the present kit 10. The frame 60 includes a front surface 62 having a first portion 64 and a second portion 65. A pair of clip members 67 is disposed in the first portion 64 in a position parallel to each other. Each of the clip members 67 has an attachment end 68 disposed proximal a bottom side 70 of the front surface 62 and an outer end 72 releasably engaging the top surface 22 of the base 20 when the base 20 is in place in the magnetic frame 60. The clip members 67 are configured to removably retain the handheld base 20 against the front surface 62 of the frame 60.

The magnetic frame 60 also includes a dispenser 75 disposed within the second portion 77 of the magnetic frame 60 front surface 62. The dispenser 75 comprises a cavity 78 therein and an opening 79 directed into the cavity 78. The cavity 78 is configured to releasably retain at least one of the cleaning sheets 40 therein. The opening 79 is configured to provide access to the cleaning sheet 40.

Each cleaning sheet 40 is formed of a cleaning substance. The cleaning substance is one of a glass cleaner, a furniture dust remover, and a furniture wax.

What is claimed is:

1. A handheld cleaning tool kit comprising:

a plurality of interchangeable cleaning sheets;

a handheld base having a top surface, a bottom surface, and a continuous perimeter therebetween;

a grip body disposed on substantially the entire bottom surface;

a non-slip exterior surface disposed on the grip body;

a plurality of spaced apart securement structures disposed within the top surface;

wherein each securement structure comprises a flexible mount portion, a cross-shaped slit centrally disposed within the mount portion, and a recess disposed within the base directly below the slit;

wherein the slit of each securement structure is configured to deflect under finger pressure into the recess;

wherein the slit of each securement structure is configured to secure a portion of one of the disposable cleaning sheets to the base upon pushing the portion of the cleaning sheet through the slit and into the recess;

a handle centrally disposed on the top surface;

wherein the non-slip exterior surface is configured to secure an interior side of the cleaning sheet to the bottom surface of the grip body;

a magnetic frame comprising:

a front surface having a first portion and a second portion;

a pair of clip members disposed in the first portion in a position parallel to each other, wherein each of the clip members has an attachment end disposed proximal a bottom side of the front surface and an outer end releasably engaging the top surface of the base when the base is in place in the frame; and wherein the clip members are configured to removably retain the handheld base against the front surface of the frame.

2. The handheld cleaning tool kit of claim 1 wherein the magnetic frame further comprises:

a dispenser disposed within the second portion of the magnetic frame front surface, wherein the dispenser comprises a cavity therein and an opening directed into the cavity; wherein the cavity is configured to releasably retain at least one of the cleaning sheets therein; wherein the opening is configured to provide access to the cleaning sheet.

3. The handheld cleaning tool kit of claim 2 wherein each securement structure is disposed one of a corner of the top surface.

4. The handheld cleaning tool kit of claim 3 wherein the handle comprises a first attachment end, a second attachment end, and a center grip portion disposed therebetween;

wherein each of the first and second attachment ends has a distal end attached to the top surface of the base and a proximal end; and wherein the distal end has a diameter larger than a diameter of the proximal end.

5. The handheld cleaning tool kit of claim 4 wherein each cleaning sheet comprises a cleaning substance.

6. The handheld cleaning tool kit of claim 5 wherein the cleaning substance is selected from the group consisting of a glass cleaner, a furniture dust remover, and a furniture wax.

* * * * *